US005346266A

United States Patent [19]

Bisbing

[11] Patent Number: 5,346,266

[45] Date of Patent: Sep. 13, 1994

[54] RACK AND PINION PULL-UP LATCH

[76] Inventor: Robert H. Bisbing, 854 Grove Ave., Springfield, Pa. 19064

[21] Appl. No.: 53,462

[22] Filed: Apr. 27, 1993

[51] Int. Cl.[5] ..... E05C 5/00

[52] U.S. Cl. ..... 292/64; 292/142; 292/DIG. 4; 292/DIG. 37

[58] Field of Search ..... 292/64, 63, DIG. 4, 292/DIG. 37, 142, 199

[56] References Cited

U.S. PATENT DOCUMENTS 508,361 11/1893 Young ..... 292/64

4,583,775 4/1986 Bisbing ..... 292/64

*Primary Examiner*—Philip C. Kannan

[57] ABSTRACT

A rack and pinion pull-up latch comprises a housing containing a reciprocating push-button which alternates between two positions. Means are provided to secure the push-button in these two positions. Supported by the push-button is a stepped pinion which engages two stationary racks within the housing and which drives a third rack between two positions of translation. At one of these positions, the third rack is rotated so as to move an attached latching finger inwardly of the housing. At the other position, the latching finger is in latching engagement with a frame member.

7 Claims, 5 Drawing Sheets

RACK AND PINION PULL-UP LATCH

BACKGROUND OF THE INVENTION

This invention relates to door latches of the type adapted to be mounted along the edge of a door which overlaps a frame and the side opposite the hinge, and more particularly to the type which draw the door forcibly against the frame. Pull-up latches of this type are disclosed in my U.S. Pat. Nos. 4,230,351, 4,556,244, 4,583,775, 4,693,503, 4,763,935 and 4,880,261.

In U.S Pat. No. 4,230,351, the output motion of the latching finger or pawl is a single angular motion, the last part of which in the opening sequence causes the latching finger to withdraw sufficiently to clear the frame or keeper. During latching, because the latching finger is rotating, it is sliding across the keeper while it is pulling up. The input is in the form of a single angular actuation of the handle.

U.S. Pat. Nos. 4,693,503 and 4,880,261 are similar in function to U.S. Pat. No. 4,230,351. The same comments apply to these, particularly with respect to the sliding action during latching.

In U.S. Pat. No. 4,556,244, the output motion of the latching finger consists first of a rotational motion to position it behind the frame, followed by a straight line pull-up. This is an obvious improvement over the above. The input is in the form of a single rotational actuation of the handle. It is noted, however, that if the handle is turned only partially, the latching finger is brought behind the frame, but no pull-up is achieved.

In U.S. Pat. No. 4,583,775, the input and output are identical to U.S. Pat. No. 4,556,244. The same comments apply to this as to U.S. Pat. No. 4,556,244.

Finally, in U.S. Pat. No. 4,763,935, the output motion of the latching finger consists of the more desirable positioning motion followed by a straight line pull-up. In this case, however, the input consists of two separate motions, a rotational motion about one axis, followed by a rotational motion about a second axis, both of which must be performed to fully latch the fastener.

My U.S. Pat. No. 4,655,489 is mentioned here merely as a reference. It shows another form of the push-release type of device incorporated in the present invention.

SUMMARY OF THE INVENTION

The present invention describes a pull-up latch adapted to be mounted in a door by means of an installation clip and which engages and pulls up forcibly against a frame. In latching, the motion of the latching finger consists of two separate and distinct motions, first that of outward motion from the housing to a position behind the frame, followed by a straight-line pull-up motion. The input consists of a single straight-line push of a button. The latch comprises a housing containing a reciprocating push-button which alternates between two positions. Means are provided to secure the push-button in these two positions. Supported by the push-button is a stepped pinion which engages two stationary racks within the housing and which drives a third rack between two positions of translation. At one of these positions, the third rack is rotated so as to move an attached latching finger inwardly of the housing. At the other position, the latching finger is in latching engagement with a frame member.

OBJECTS OF THE INVENTION

It is therefore an object of the present invention to provide a pull-up latch in which the output motion of the latching finger consists of two separate and distinct motions, first that of outward motion from the housing to a position behind the frame, followed by a straight line pull-up motion.

It is a further object of the invention to provide the above two step latching action with a single input action, specifically that of pushing on a button.

It is a further object of the invention to provide for unlatching with another single pushing motion.

It is a further object of the invention to provide a latch which, though relatively flush with the door when in the latched position, provides sufficient purchase for pulling the door open when it is unlatched.

It is a further object of the invention to provide a latch which may be economically manufactured by molding from a thermoplastic.

DESCRIPTION OF THE PREFERRED EMBODIMENT

The preferred embodiment of the present invention is shown in FIGS. 1 through 16 inclusive.

Figure 1:
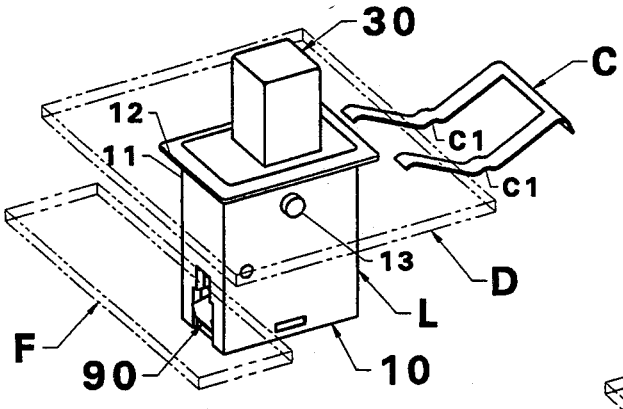
FIG. 1 a front and side perspective view of the rack and pinion pull-up latch showing it partially installed in a door and in the unlatched position.

FIG. 1 shows the rack and pinion pull-up latch L positioned in a rectangular opening in a door D and an installation clip C in a pre-installed position on the underside of door D. In proximity to latch L is a frame F appropriately spaced behind the rear surface of door D. The components of latch L visible in FIG. 1 are a housing 10, a button 30 and a pawl 90. Housing 10 comprises a generally rectangular prismatic body 11 with a flange 12 adapted to lie on the outer surface of door D and a pair of projections 13 on opposite sides of body 11 adapted to engage a pair of depressions C1 on installation clip C. Installation clip C is preferably made of a spring-like material and in a shape such that it must be flattened somewhat when it is moved into engagement with projections 13 and thus securely hold latch L in door D. In FIG. 1, button 30 is shown in a fully extended position and pawl 90 is shown in a fully retracted unlatched position. This configuration allows door D to be opened, moving in a direction perpendicular to and away from frame F.

Figure 2:
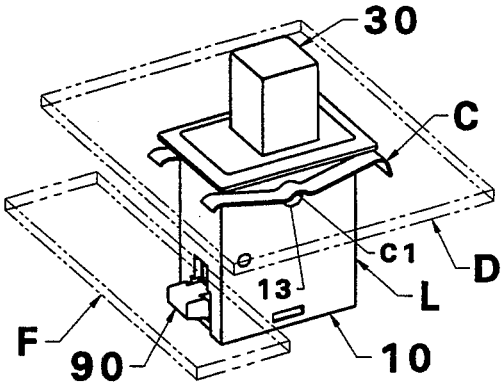
FIG. 2 is a front and side perspective view of the rack and pinion pull-up latch showing it installed in the door and in a partially latched position.

FIG. 2 shows latch L installed in door D with installation clip C in the installed position with depressions C1 engaging projections 13. This method of installation using an installation clip as described is known prior art. In FIG. 2, button 30 is shown partially depressed and pawl 90 is shown in a fully extended position behind, and spaced away from, the underside of frame F. In this partially latched configuration, door D is restrained from opening, but not yet held closed with any force.

Figure 3:
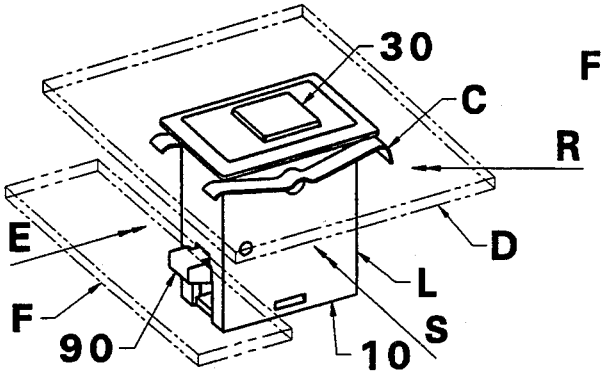
FIG. 3 is a front and side perspective view of the rack and pinion pull-up latch showing it installed in the door and in the fully latched position.

FIG. 3 shows installed latch L in the fully latched position with button 30 almost flush with housing 10 and pawl 90 fully extended and in forcible contact with the underside of frame F.

Figure 4:
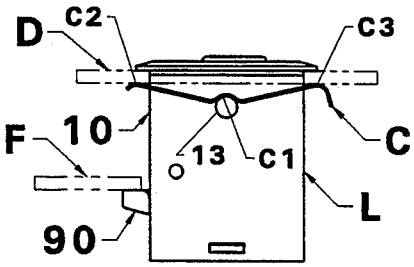
FIG. 4 is a side elevation of view of FIG. 3 as viewed in the direction S of FIG. 3.

FIG. 4 is a side elevation view of FIG. 3 as viewed in the direction S of FIG. 3, showing one depression C1 engaging one projection 13, showing ends C2 and C3 of installation clip C in firm contact with the underside of door D and showing pawl 90 in forcible contact with the underside of frame F.

Figure 5:
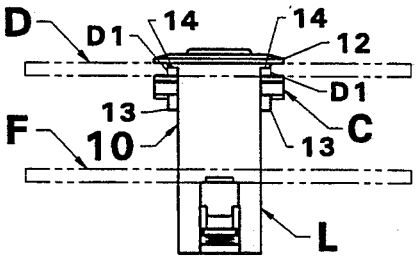
FIG. 5 is an end elevation view of FIG. 3 as viewed in the direction E of FIG. 3.

FIG. 5 is an end elevation view of FIG. 3 as viewed in the direction E of FIG. 3, showing a pair of steps 14 located on the underside of flange 12, whose purpose it is to center latch L in the hole D1 in door D. The width of hole D1 must be such as to allow passage of projections 13. An alternative construction would be to omit steps 14, to reduce the width of hole D1, and to provide notches in the sides of hole D1 to allow passage of projections 13. This is not a preferred embodiment because it requires that the installer of the latch provide a special shaped hole instead of a simple rectangular one.

Figure 6:
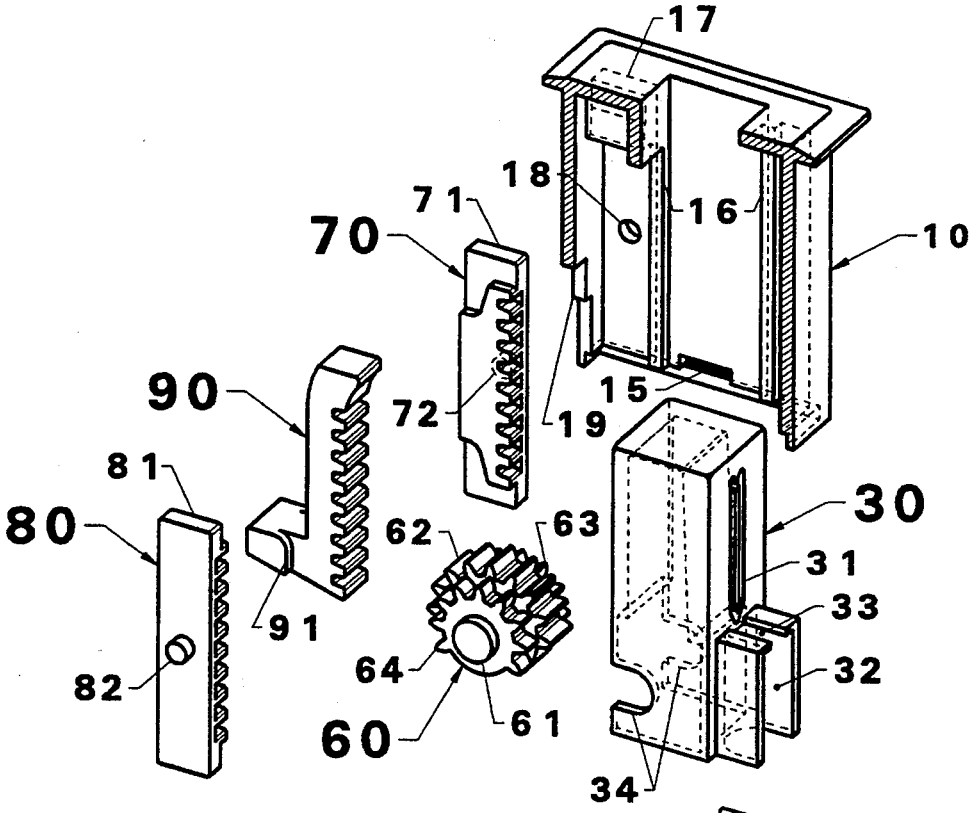
FIG. 6 is an exploded rear and side perspective view as viewed in the direction R of FIG. 3, shown partially in section, and showing all of the components of the rack and pinion pull-up latch.

All of the components of the preferred embodiment are shown in FIG. 6. They consist of housing 10, cover 20, button 30, link 40, spring 50, pinion 60, racks 70 and 80, and pawl 90. With the exception of link 40 and spring 50, all components are preferably made of thermoplastic for reasons of practical construction and economy. Link 40 in this preferred embodiment is made of heavy stainless steel wire. Spring 50 is constructed from spring wire. Near the lower end of housing 10, shown in bisected section, are two rectangular openings 15 adapted to receive and retain in snap-in fashion two legs 21 on cover 20, also shown in bisected section. This construction will be shown in greater detail later. Within housing 10, are two pairs of rails 16 which guide button 30, allowing it to move in a vertical direction. In the rearward face of button 30 is a recessed track 31 in the form of an elongated continuous loop. Upper end 41 of link 40 engages track 31, is biased inwardly in track 31 in a manner which will be described in detail later, and moves around in track 31 in response to motion imparted to button 30, also in a manner which will be described in detail later. Lower end 42 of link 40 is retained in a shaped slot 22 in cover 20. Spring 50 is disposed around link 40 and guided and positioned by circular boss 23 on cover 20 and semi-circular pocket 32 in button 30. Rectangular opening 33 at the upper end of semi-circular pocket 32 is sufficiently wide to allow passage of link 40 but not spring 50 The primary purpose of spring 50 is to bias the button in the upward direction.

In both sides of button 30 are two round-ended slots 34 adapted to receive and support two trunnions 61 on pinion 60 Upper end 71 of rack 70 is retained in pocket 17 of housing 10 and restrained from moving vertically by virtue of projection 72 engaging hole 18. In like manner, upper end 81 and projection 82 on rack 80 engage and are retained by identical pockets and holes in the other half of housing 10. Pawl 90 is sandwiched between racks 70 and 80, and once in position serves to maintain the engagement of projections 72 and 82 with their respective holes.

In this preferred embodiment, pinion 60 is made up of three gear sectors, a middle sector 62 and two identical outer sectors 63 and 64 of a smaller pitch diameter than that of sector 62. The gear teeth of middle sector 62 engage the teeth of pawl 90 and the gear teeth of outer sectors 63 and 64 engage the teeth of racks 70 and 80 respectively. In addition to providing a functional feature which will be described in detail later, the reason for using sectors rather than full gears is to minimize space requirements. Alternatively, the respective pitch diameters of the gear sectors could be interchanged, but this would complicate manufacture. Also alternatively, two gear sectors could be used instead of three, but the use of three results in a balanced load on pinion 60.

Figure 7:
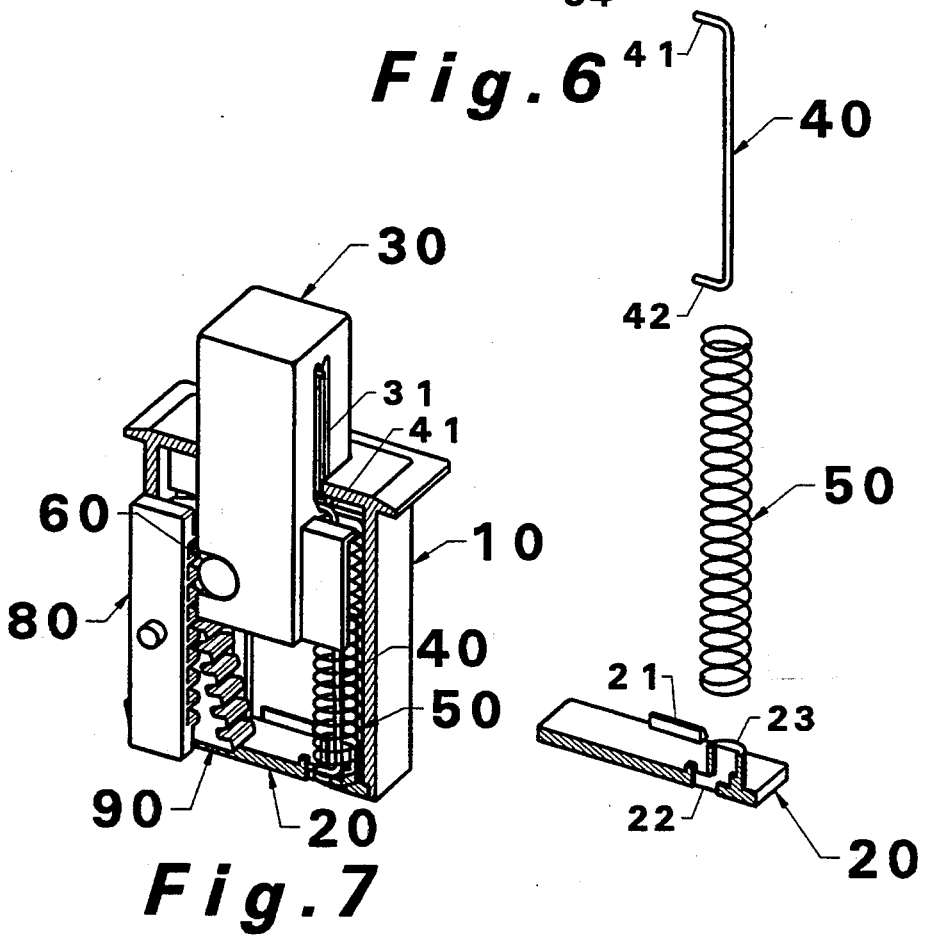
FIG. 7 is a perspective view taken in the same direction as FIG. 6, shown partially in section, and showing the components assembled and in the unlatched position.

FIG. 7 shows the components of the rack and pinion pull-up latch in the assembled and unlatched position. It should be noted for future reference that in this configuration, pawl 90 is tilted inwardly and end 41 of link 40 is in engagement with the lower end of track 31 in button 30, thereby limiting the upward travel of button 30.

Figure 8:
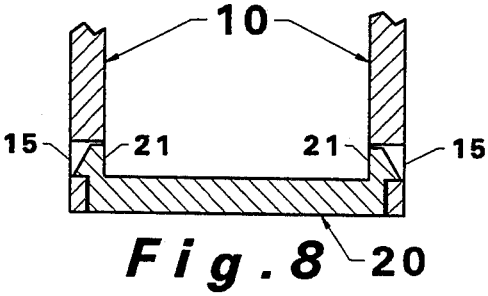
FIG. 8 is an end elevation fragmented sectional view of the housing 10 and the cover 20 as defined in FIG. 6.

FIG. 8 shows a partial cross-section taken through openings 15 in housing 10 and through legs 21 of cover 20. The fact that the side walls of housing 10 can be sprung apart somewhat allows cover 20 to be snapped into the position shown.

Figure 9:
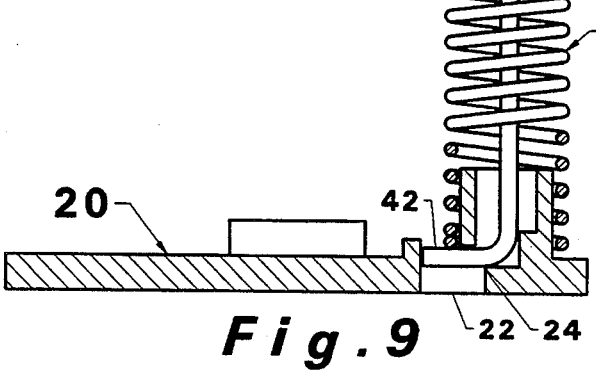
FIG. 9 is a side elevation view, shown partially in section, and showing the cover 20, the link 40 and the spring 50 as defined in FIG. 6 in their assembled configuration.

FIG. 9 shows link 40 in its assembled position in shaped slot 22 of cover 20. Upper end 41 of link 40 is biased in the direction A by the force exerted by spring 50 upon lower end 42 which in turn rests upon fulcrum corner 24. This biasing serves to keep the upper end 41 of link 40 in contact with the bottom of track 31.

Figure 10:
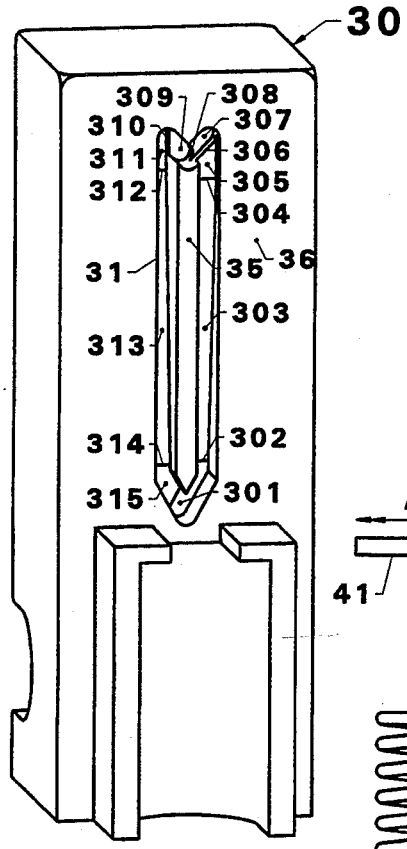
FIG. 10 is a more rearward perspective view of the button 30 as viewed and is defined in FIG. 6.
Figure 11:
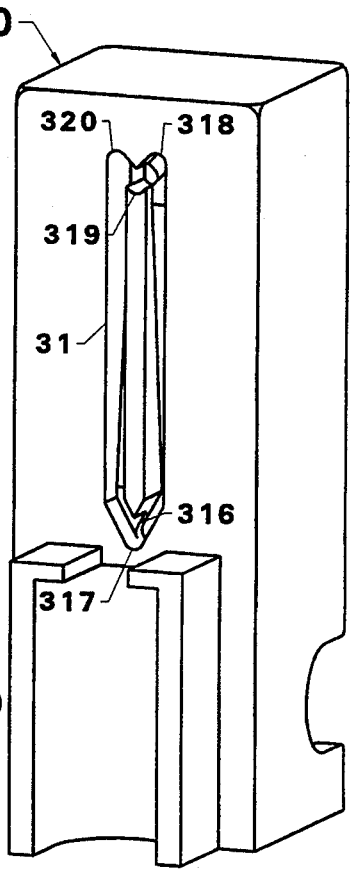
FIG. 11 is a further rotated perspective view of the button 30 shown in FIG. 10.

FIGS. 10 and 11 show recessed track 31 in greater detail. Track 31 is in the form of an elongated continuous loop, surrounding an island 35, the face of which is flush with face 36. All surfaces at the bottom of track 31 are at varying depths in relation to face 36. As measured from face 36, surface 301 is relatively deep. Surface 301 extends in an upward and rightward direction at a constant depth to transition line 302. Surface 303 of gradually decreasing depth extends in an upward direction from transition line 302 to transition line 304. Surface 305 extends in an upward direction at a constant depth from transition line 304 to an abrupt inward step 306. Surface 307 extends in a downward and leftward direction at a constant depth from step 306 to a second abrupt inward step 308. Surface 309 extends in an upward and leftward direction at a constant depth from step 308 to a third abrupt inward step 310. Surface 311 extends in a downward direction at a constant depth from step 310 to transition line 312. Surface 313 of gradually decreasing depth extends in a downward direction from transition line 312 to transition line 314. Finally, surface 315 extends in a downward and rightward direction at a constant depth from transition line 314 to a fourth abrupt inward step 316, returning to the starting depth of surface 301. In summary, the bottom surface of track 31, in travelling along it in the direction described, consists of a series of flat areas separated by abrupt downward steps and two gradual upward inclines. At the intersection of track segments defined by surfaces 315 and 301, there is a resulting semi-circular pocket 317 of depth equal to that of surface 301. Similarly, semi-circular pockets 318, 319 and 320 result with depths equal to those of surfaces 307, 309 and 311 respectively.

Using as a starting point the configuration shown in FIG. 7, button 30 is at its upward extreme position and end 41 of link 40 is in engagement with the lower end of track 31. Referring to FIGS. 10 and 11, end 41, though not shown for purposes of clarity, is in pocket 317 and resting against surface 301. As the button is depressed to actuate the latch, end 41, not being able to traverse step 316, has only one possible direction of travel, that being along surfaces 301, 303 and 305, then down step 306, finally coming to rest in pocket 318. At this point, button 30 resists further downward pressure. As a result of the upward biasing of button 30 by spring 50, a subsequent release of downward pressure on button 30 will cause it to move back up. In response to this motion, end 41 of link 40, not being able to traverse step 306, has only one possible direction of travel, that being along surface 307, then down step 308, finally coming to rest in pocket 319. In this position button 30 is restrained from further upward motion and the latch is in the fully latched position. In response to another application of pressure to button 30, end 41 traverses surface 309 and step 310 in a manner similar to the above, coming to rest and resisting further pressure in pocket 320. Release of pressure on button 30 then causes end 41 to traverse surfaces 311, 313 and 315 and step 316, coming to rest in the initial position in pocket 317.

The net result of this action is that with repeated separate pushes on button 30, it alternates between extended and depressed positions. This method of obtaining such alternating positions of a member as a result of successive identical inputs, as well as other similar devices which accomplish the same result, is known prior art, but a desirable feature in the present invention. The particular method used here of biasing end 41 of link 40 towards the bottom of track 31 is not prior art and is considered to be a part of the present invention.

FIGS. 12 through 15 are side elevation views, partially in section, with rack 80 and outer sector 64 of pinion 60 removed for clarity, and with the hidden portions of rack 70 and inner sector 63 shown in phantom. A detailed description of the operation is best started at FIG. 13. In the position shown in FIG. 13, button 30 has been partially depressed from its fully extended unlatched position. Pawl 90 is in a fully extended position, but has not yet started any upward travel. End 41 has started its travel along surface 301. Tooth 621 of sector 62 is in engagement with space 901 of pawl 90 and tooth 631 of sector 63 is in engagement with space 701 of rack 70.

Figure 14:
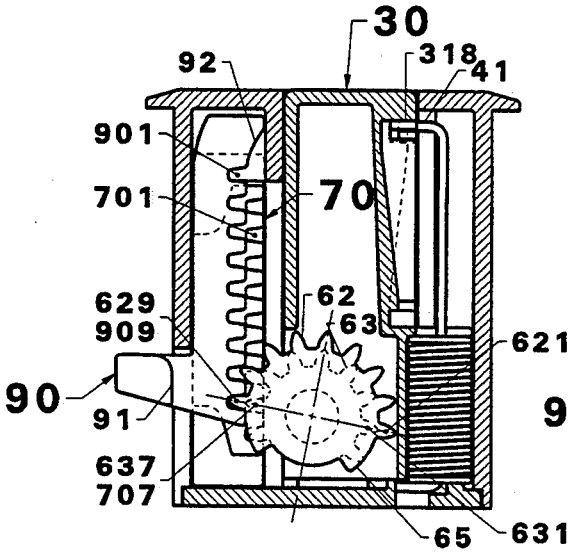
FIG. 14 is a similar side elevation view showing the rack and pinion pull-up latch in a second partially latched position.

In FIG. 14, button 30 has been depressed to its fullest extent of travel. End 41 is in pocket 318 and sector 63 has traveled down rack 70, rotating clockwise slightly more than 180 degrees in the process. Tooth 637, diametrically opposite tooth 631, is now in a position of approximately full engagement with space 707 of rack 70 and tooth 629, diametrically opposite tooth 621, is in a position of approximately full engagement with space 909 of pawl 90.

Figure 15:
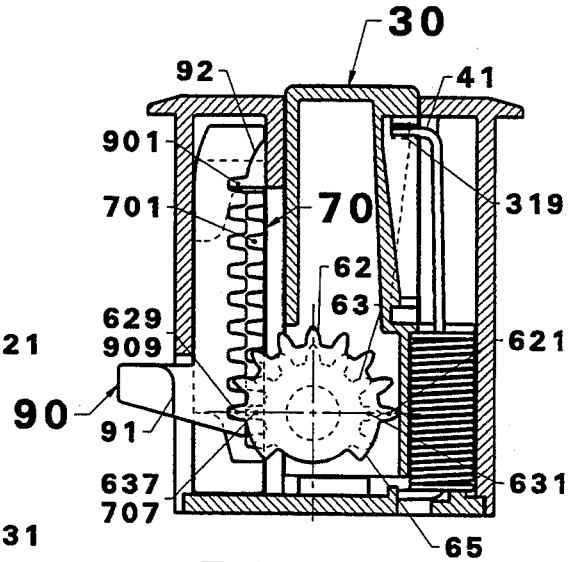
FIG. 15 is a similar side elevation view showing the rack and pinion pull-up latch in the fully latched position.

In FIG. 15, button 30 has been released, allowing end 41 to drop back into pocket 319. The latch is now secured in the fully latched position. Tooth 637 is now in full engagement with space 707 and tooth 629 is now in full engagement with space 909. The net result in going from the configuration shown in FIG. 13 to that shown in FIG. 15 is that pinion 60, and hence button 30 have travelled downward a distance equal to six times the pitch, or distance between adjacent gear teeth, whereas pawl 90 has travelled upward a distance equal to two times the pitch. This is a consequence of the fact that in the 180 degrees of rotation, sector 62 has two more teeth than sector 63. This principle of operation of a stepped gear such as this is well known in the art and not relied upon in itself as being inventive.

Because button 30 travels three times the distance that pawl 90 travels, a force applied to button 30 is multiplied by a factor of three in the force applied by pawl 90 to the underside of frame F. In reality, the overall mechanical advantage of the pull-up latch is four to one rather than three to one because the force applied to button 30, transmitted ultimately to the door, also contributes to the overall latching force.

While this preferred embodiment shows gear sectors having identical pitches, that is tooth sizes, this is not a requirement. The important feature is that the sectors be of differing diameters. In this preferred embodiment, a gear tooth form having a relatively small pressure angle has been used in order to minimize the radial forces normally created between a gear and its mating rack. Excessive side forces would result in undesirable friction forces, causing the button to stick.

Figure 13:
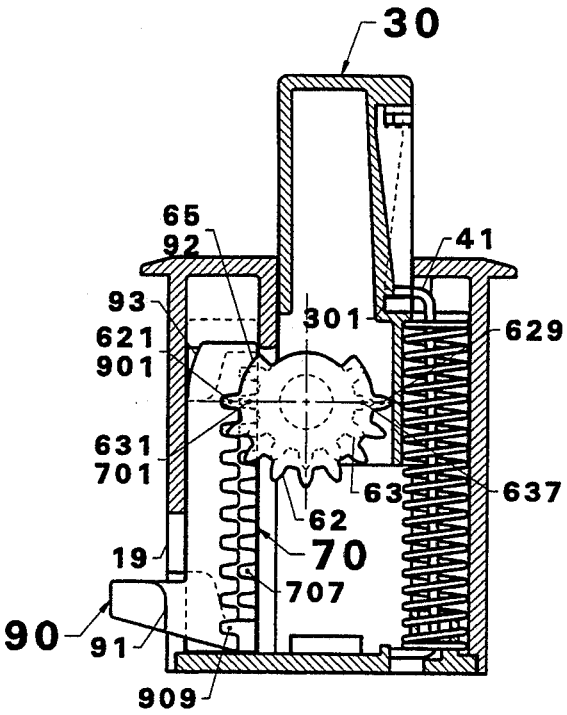
FIG. 13 is a similar side elevation view showing the rack and pinion pull-up latch in a partially latched position.

During the transition from the partially latched position of FIG. 13 to the latched position of FIG. 15, shoulders 91 on pawl 90 move into engagement with steps 19 of housing 10 (best seen in FIG. 6), providing support for pawl 90 and removing side forces between pawl 90 and pinion 60.

It may be noted that the position of pawl 90 is somewhat higher in FIG. 14 than its position in FIG. 15, the fully latched position. If the door and frame were infinitely rigid, this situation would not be permissible, but in real life, there is sufficient spring in the door and frame to permit the slight amount of overcompression resulting from the position of the pawl as seen in FIG. 14.

Figure 12:
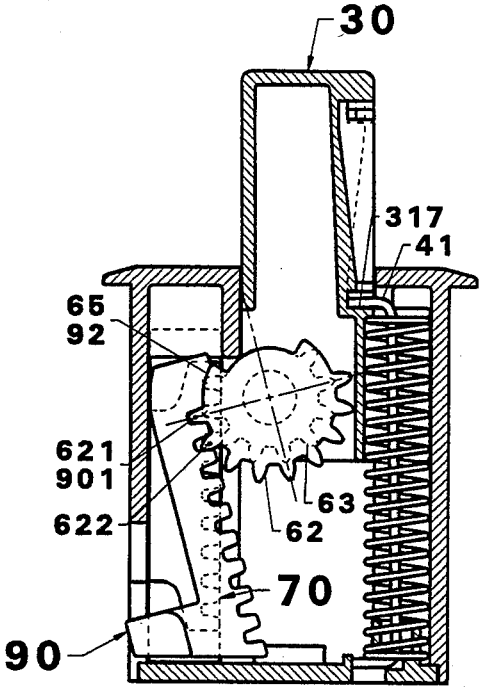
FIG. 12 is a side elevation view, partially in section, showing the rack and pinion pull-up latch in the unlatched position, with some details omitted for clarity, as viewed in the same direction as FIG. 4.

The sequence when unlatching is, starting with FIG. 15, button 30 is again depressed, returning the components to the positions shown in FIG. 14, with the exception that end 41 is now in pocket 320 (not shown in FIG. 14). A subsequent release of the pressure on button 30 now allows the assembly, under the influence of spring 50 to return through the configuration shown in FIG. 13 and stop at the configuration shown in FIG. 12. During this return travel, arcuate surface 65 of sector 62 comes into contact with arcuate surface 92 of pawl 90. This occurs at the position shown in FIG. 13. With further upward and rotational motion of pinion 60 in going from the position shown in FIG. 13 to that shown in FIG. 12, pawl 90 follows the motion of pinion 60, resulting in retraction of pawl 90 into housing 10, thus providing clearance for frame F when door D is moved outwardly away from frame F. Arcuate surface 93 on pawl 90 also allows for this motion of pawl 90. As can be seen in FIG. 12, button 30 is at its most upward extreme of travel and can be easily grasped by the fingers, providing means for opening the door. The side surfaces of button 30 could be serrated or otherwise textured to enhance this feature if desired.

During the initial stage of latching, in going from the configuration of FIG. 12 to that of FIG. 13, tooth 621 and the next adjacent tooth 622 cause pawl 90 to rotate back out to the extended position.

Figure 16:
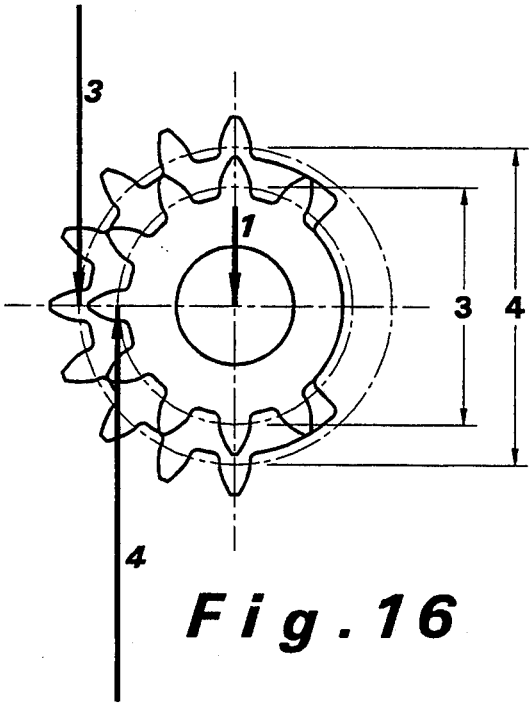
FIG. 16 is vectorial representation of the forces acting upon the pinion 60 as defined in FIG. 6.

FIG. 16 is a vectorial representation of the forces acting upon pinion 60 of the preferred embodiment. The ratio of pitch diameters of sectors 63 and 62 is three to four, so that for every three units of resistance applied by the pawl to the pinion, only one unit of force need be applied by the button to the pinion. The four unit force shown is the balancing force provided by the stationary rack, which represents the fulcrum in this equivalent of a class 1 lever. This demonstrates, in an alternate manner, that, for this preferred embodiment, the mechanical advantage provided by the stepped pinion is three to one. It may be readily seen that if the diameters of the two sectors are very close to on another, the mechanical advantage will be very high. It is equally obvious that if the diameter of the smaller sector is made one-half the diameter of the larger sector, the mechanical advantage will be one to one. This arrangement could be used where a shorter travel of the button is desired and where a force multiplication is not desired.

Figure 17:
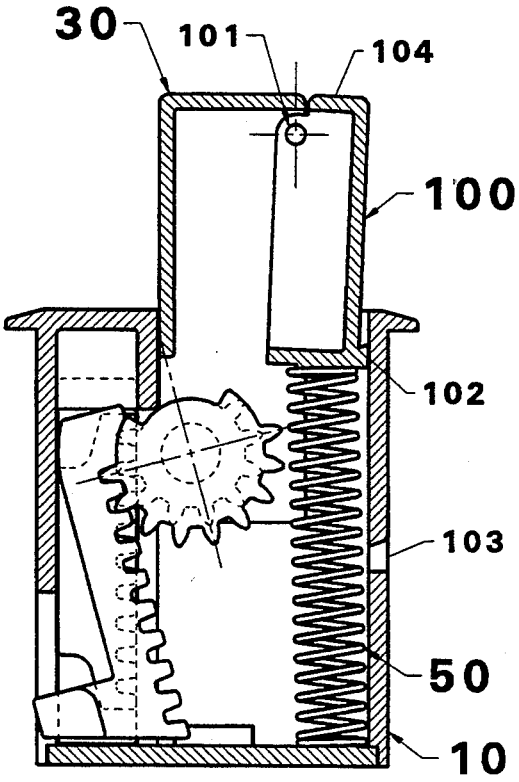
FIG. 17 is a side elevation view of an alternate embodiment of the rack and pinion pull-up latch, shown in the unlatched position.
Figure 18:
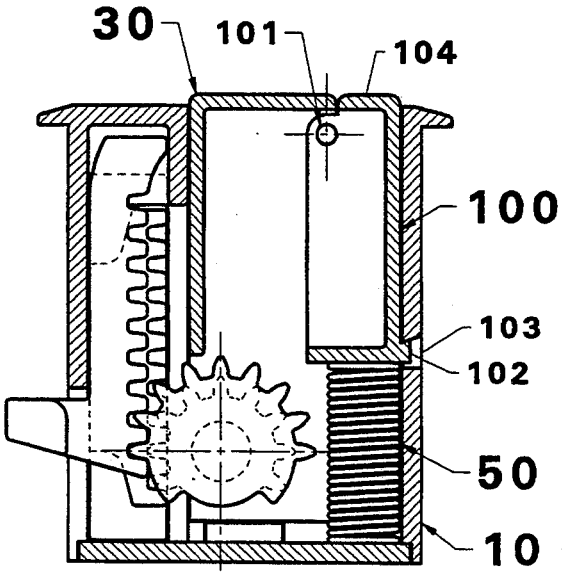
FIG. 18 is a side elevation view of the same alternate embodiment, shown in the fully latched position.

FIGS. 17 and 18 show an alternate embodiment of the rack and pinion pull-up latch in which the alternating push function provided by link 40 and track 31 has been replaced by separate locking and unlocking functions by the addition of a trigger 100. Trigger 100 is pivoted to button 30 by a cross pin 101. To latch, the button is depressed, causing projection 102 on trigger 100, being biased against the side wall of housing 10 by spring 50, to slide down this side wall until it encounters and snaps into opening 103. To unlatch, top surface 104 of trigger 100 is depressed, causing projection 102 to exit opening 103, allowing, with release of pressure, the return to the unlatched position. This embodiment and various similar mechanisms to accomplish the purpose of locking the rack and pinion pull-up latch in the latched position are within the scope of the invention.

The preferred embodiment of the invention has been described for the purpose of illustration and is not intended to limit the invention. Various modifications or alternatives may suggest themselves to those skilled in the art, all of which are within the spirit and scope of the invention as defined by the claims.

What is claimed is:

1. A rack and pinion pull-up latch comprising a housing, a first rack fixed within said housing, a second rack disposed within said housing and adapted for reciprocating motion within said housing, said second rack having a latching finger projecting through a wall of said housing, a push-button disposed within said housing and adapted for reciprocating motion within said housing, means provided to secure said push-button in positions substantially corresponding to both extremes of travel of said push-button, a stepped pinion having two sets of gear teeth of differing pitch diameters pivotally secured to said push-button and in engagement with said first rack and said second rack, whereby, in response to motion imparted to said push-button, said second rack is caused to move in a direction opposite to said motion imparted to said push-button.

2. A rack and pinion pull-up latch comprising a housing, a first rack fixed within said housing, a second rack disposed within said housing and adapted for reciprocating motion within said housing, said second rack having a latching finger projecting through a wall of said housing, a push-button disposed within said housing and adapted for reciprocating motion within said housing, means provided to secure said push-button in positions substantially corresponding to both extremes of travel of said push-button, a stepped pinion having two sets of gear teeth of differing pitch diameters pivotally secured to said push-button and in engagement with said first rack and said second rack, whereby, in response to motion and force imparted to said push-button, said second rack is caused to move in a direction opposite to said motion imparted to said push-button and at a substantially reduced rate of speed and with a corresponding substantially increased force with respect to said motion and force imparted to said push-button.

3. The assembly of claim 1, wherein means are provided to move said second rack pivotally about the axis of said pinion as said push-button approaches one extreme of travel, whereby said latching finger is caused to move inwardly of said housing at said extreme of travel.

4. The assembly of claim 3, wherein said means provided to move said second rack pivotally comprises an arcuate surface on said pinion adapted to contact a mating arcuate surface on said second rack as said push-button approaches said extreme of travel.

5. The assembly of claim 4, wherein said means provided to secure said push-button in positions substantially corresponding to both extremes of travel comprises, in combination, a wire-form link having a bend at both ends, a first end of said link in pivotal engagement with said housing, a second end of said link in engagement with a slot in said push-button, said slot having the form of an endless elongated track having a series of flat areas separated by steps and inclines on its bottom surface, a spring having a first end in engagement with said housing and said first end of said link whereby said second end of said link is biased inwardly of said slot, said spring having a second end in engagement with said push-button whereby said push-button is biased towards one extreme of travel, whereby, in response to alternating pushes and releases of said push-button against said biasing of said push-button, said push-button alternates between said positions substantially corresponding to both extremes of travel.

6. The assembly of claim 4, wherein said means provided to secure said push-button in positions substantially corresponding to both extremes of travel comprises, in combination, a trigger pivotally attached to said push-button and adapted to engage said housing and secure said push-button at a first extreme of travel in said housing, a spring having a first end in engagement with said housing and a second end in engagement with said trigger whereby said trigger is biased in one pivotal direction with respect to said push-button and whereby said push-button is biased towards a second extreme of travel in said housing, whereby, in response to alternating actuations of said push-button and said trigger, said push-button alternates between said positions substantially corresponding to both extremes of travel.

7. A rack and pinion pull-up latch comprising a housing, a first rack fixed within said housing, a second rack spaced apart from said first rack and fixed within said housing, a third rack disposed between said first rack and said second rack and adapted for reciprocating motion and rotary motion within said housing, said third rack having a latching finger projecting through a wall of said housing and having an arcuate surface extending from the last tooth at one end, a push-button disposed within said housing and adapted for reciprocating motion within said housing, a stepped pinion pivotally secured to said push-button, said stepped pinion having a first gear sector in engagement with said first rack, a second gear sector of pitch diameter equal to the pitch diameter of said first gear sector in engagement with said second rack and a third gear sector of pitch diameter different from the pitch diameters of said first and second gear sectors in engagement with said third rack, said third gear sector having an arcuate surface on a portion of its periphery adapted to engage said arcuate surface on said third rack at one extreme of travel of said third gear sector with respect to said third rack, a wire-form link having a bend at both ends, a first end of said link in pivotal engagement with said housing, a second end of said link in engagement with a slot in said push-button, said slot having the form of an endless elongated track having a series of flat areas separated by steps and inclines on its bottom surface, a spring having a first end in engagement with said housing and said first end of said link whereby said second end of said link is biased inwardly of said slot, said spring having a second end in engagement with said push-button whereby said push-button is biased towards one extreme of travel, whereby, in response to alternating pushes and releases of said push-button against said biasing of said push-button, said third rack is caused to alternate between two extremes of translational and rotational motion.

* * * * *